US006767088B2

(12) United States Patent
Sarmast

(10) Patent No.: US 6,767,088 B2
(45) Date of Patent: Jul. 27, 2004

(54) METHODS AND SYSTEMS FOR DETECTING AND DETERMINING TRAJECTORIES OF INK DROPLETS

(75) Inventor: Sam Sarmast, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/906,368

(22) Filed: Jul. 16, 2001

(65) Prior Publication Data

US 2003/0011663 A1 Jan. 16, 2003

(51) Int. Cl.[7] ..... B41J 2/925
(52) U.S. Cl. ..... 347/81
(58) Field of Search ..... 347/73, 78, 81; 346/75

(56) References Cited

U.S. PATENT DOCUMENTS 3,864,692 A 2/1975 McDonnell et al.
3,886,564 A * 5/1975 Naylor, III et al. ..... 346/75
4,136,345 A * 1/1979 Neville et al. ..... 346/75
4,190,844 A * 2/1980 Taylor ..... 347/82
4,417,256 A * 11/1983 Fillmore et al. ..... 347/78
4,540,990 A 9/1985 Crean
4,542,385 A 9/1985 Jinnai et al.
4,590,483 A 5/1986 Regnault et al.

FOREIGN PATENT DOCUMENTS

EP 1245397 A1 * 10/2002 ..... B41J/2/125
JP 2063745 A 3/1990

* cited by examiner

*Primary Examiner*—Anh T. N. Vo

(57) ABSTRACT

Methods and systems for detecting ink droplets ejected by a printer, and for determining if the trajectory of an ink droplet deviates from a desired trajectory. In one embodiment, the ink droplet trajectory detector has multiple electrically conductive, electrically isolated sensors. Each of said sensors is configured to generate an electrical signal when an ink droplet passes in proximity thereof, without requiring the ink droplet to physically engage any portion of said sensors. The ink droplet trajectory detector also has at least one structure orienting said sensors relative to one another.

52 Claims, 5 Drawing Sheets

METHODS AND SYSTEMS FOR DETECTING AND DETERMINING TRAJECTORIES OF INK DROPLETS

TECHNICAL FIELD

This invention relates to inkjet printers and, in particular, to systems and methods for processing ink.

BACKGROUND

Many types of printers are widely used today. One of the major types is the inkjet printer. An inkjet printer is a type of non-impact printer that forms images by controllably spraying drops of ink from a print head. Often the print head is part of a mobile print carriage that can traverse a given axis within the printer. It is common for inkjet printers to have more than one print head, especially color printers. Commonly, color inkjet printers have print heads containing various colors of ink including black ink. Each print head contains nozzles through which ink drops are ejected. The print nozzles eject or shoot ink drops across a small air gap onto a print media. Various inkjet printers are described in the following references: U.S. Pat. Nos. 6,234,613, 6,227, 640, 6,193,345, and 6,179,414.

Several types of inkjet printers exist. One common type is a thermal inkjet printer. A processor of the thermal inkjet printer can apply a driving voltage to a thermal resistor contained in a nozzle. The driving voltage heats the resistor and indirectly the surrounding ink. This increased temperature results in increased pressure within the nozzle. The pressure causes some of the ink to be ejected from the nozzle in the form of drops or droplets. The thermal resistors are commonly formed on a single silicon wafer chip mounted in the print head. Exemplary printers are described in the following references U.S. Pat. Nos. 6,183,078, and 6,070, 969. Another common type of inkjet printer uses piezoelectric crystals to force ink drops from the print nozzle in response to a signal.

Whatever control mechanism is used, the print nozzles are generally arranged in a print head and are oriented to shoot their ink in a desired direction from the print head towards the print media. However, it is not uncommon for print nozzles to become misaligned during assembly or to later become misaligned through use or transport. Any misalignment degrades the quality of the product produced by the printer since some of the drops end up in unintended locations on the print media. Specifically, this can cause blurring and other quality control problems. Print nozzles can also become clogged and stop functioning, further detracting from print image quality.

Attempts have been made to sense whether print nozzles are firing or not. However, these technologies require that the ink droplet physically contact the sensor thereby making it impossible to monitor for ink droplets while the printer is actually printing. Further attempts have been made to monitor the size and location of ink droplets using photo detectors. However, this technology is prone to failure due to contamination of the detector by ink particles. For references that discuss aspects of ink droplet detectors, the reader is referred to the following references: U.S. Pat. Nos. 6,227, 644, and 6,086,190.

Accordingly, the present invention arose from concerns associated with providing improved image quality in inkjet printers by reducing degradation caused by print nozzle misalignment and malfunction.

SUMMARY

Methods and systems for detecting ink droplets ejected by a printing device, and for determining whether the trajectory of the ink droplet deviates from a desired trajectory are described. One embodiment comprises an ink droplet trajectory detector which has multiple electrically conductive, electrically isolated sensors. At least one structure orients the sensors relative to one another. Each sensor can generate an electrical signal when an ink droplet passes in proximity to it. The sensors can generate a signal without an ink droplet physically engaging any portion of the sensors. Sensor-generated signals can then be processed to ascertain ink droplet trajectories.

In another embodiment, the ink droplet trajectory detector comprises an open-ended structure having multiple joined sides that define a passageway. Ink droplets can pass through the passageway. Multiple sensors are supported by the structure, with each side of the structure supporting at least one sensor. The sensors can generate signals when an ink droplet passes in proximity thereto. Sensor-generated signals can then be processed to ascertain ink droplet trajectories.

In a further embodiment, a method for determining a trajectory of an ink droplet comprises providing a sensor structure that can sense trajectories of ink droplets without physically contacting the ink droplets. An ink droplet is ejected from a print nozzle along a path that extends through the sensor structure. Multiple signals are produced from the structure upon passage of an ink droplet through the sensor structure. The signals can be processed to ascertain ink droplet trajectories.

BRIEF DESCRIPTION OF THE DRAWINGS

The same numbers are used throughout the drawings to reference like features and components.

DETAILED DESCRIPTION

Overview

In accordance with the embodiments described below, sensor arrangements are provided so that ink droplets ejected from a printer can be sensed and their trajectories can be determined. Deviations from desired trajectories can be determined, and, in some embodiments, the printer can then correct for such deviations in future printing, or take other remedial measures.

Exemplary Printer Architecture

Figure 1:
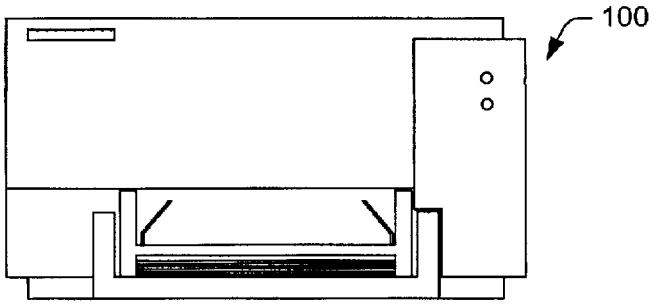
FIG. 1 is a front elevational view of an exemplary inkjet printer.

FIG. 1 shows a printer 100, embodied in the form of an inkjet printer. The printer 100 can be representative of an inkjet printer series manufactured by the Hewlett-Packard Company under the trademark "Deskjet". The inkjet printer 100 is capable of printing in black-and-white and in color. The term "printer" refers to any type of printer or printing device which ejects ink or other pigmented materials onto a print media. Though an inkjet printer is shown for exemplary purposes, it is noted that aspects of the described embodiments can be implemented in other forms of printing devices that employ inkjet printing elements or other ink ejecting devices, such as facsimile machines, photocopiers, scanners, and the like.

Figure 2:
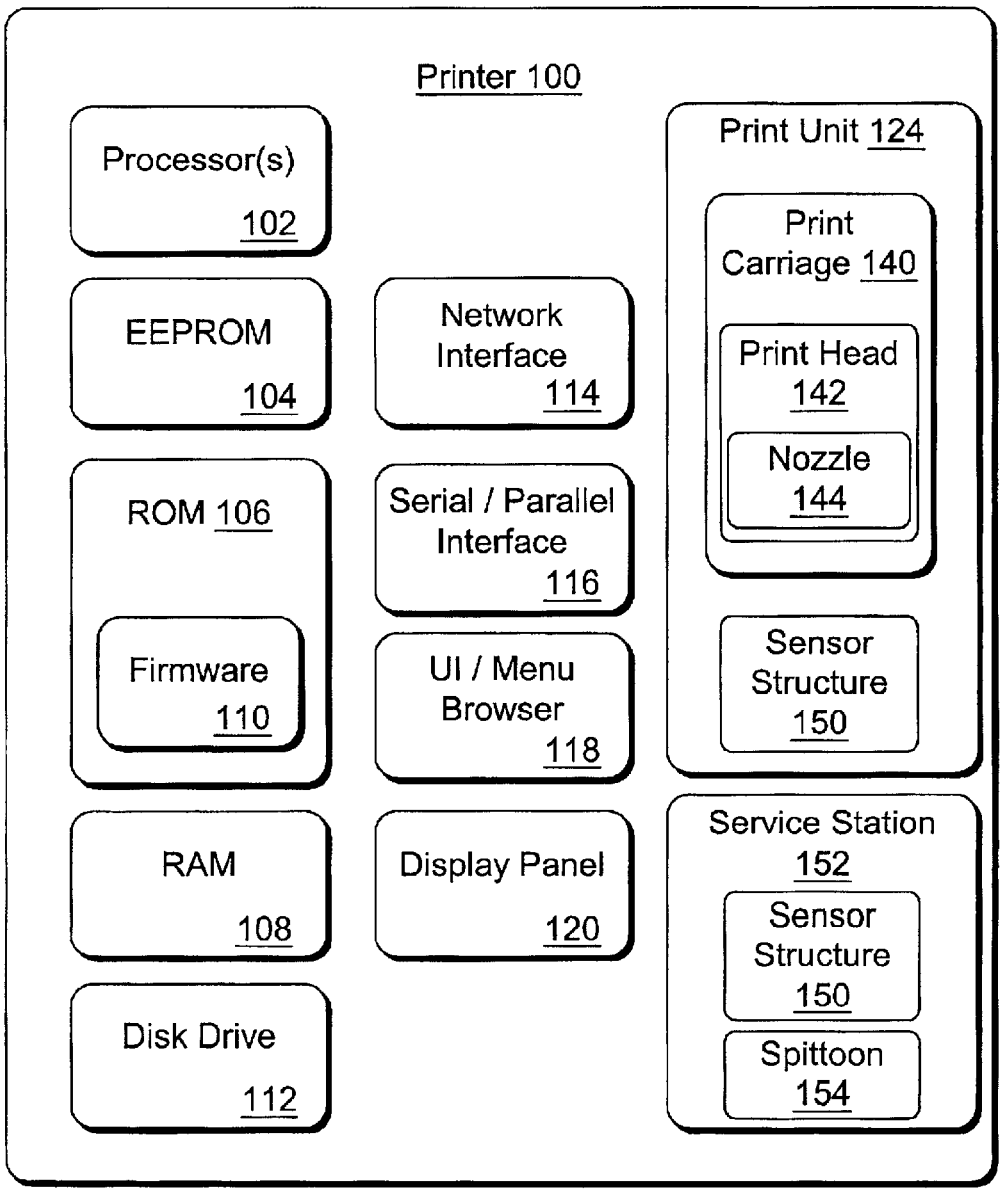
FIG. 2 is block diagram that illustrates various components of an exemplary printing device.

FIG. 2 illustrates various components of printer 100 that can be utilized to implement the inventive techniques described herein. Printer 100 can include one or more processors 102. The processor 102 controls various printer operations, such as media handling and carriage movement for linear positioning of the print head over a print media (e.g., paper, transparency, etc.).

Printer 100 can have an electrically erasable programmable read-only memory (EEPROM) 104, ROM 106 (non-erasable), and a random access memory (RAM) 108. Although printer 100 is illustrated having an EEPROM 104 and ROM 106, a particular printer may only include one of the memory components. Additionally, although not shown, a system bus typically connects the various components within the printing device 100.

The printer 100 can also have a firmware component 110 that is implemented as a permanent memory module stored on ROM 106. The firmware 110 is programmed and tested like software, and is distributed with the printer 100. The firmware 110 can be implemented to coordinate operations of the hardware within printer 100 and contains programming constructs used to perform such operations.

Processor(s) 102 process various instructions to control the operation of the printer 100 and to communicate with other electronic and computing devices. The memory components, EEPROM 104, ROM 106, and RAM 108, store various information and/or data such as configuration information, fonts, templates, data being printed, and menu structure information. Although not shown, a particular printer can also include a flash memory device in place of or in addition to EEPROM 104 and ROM 106.

Printer 100 can also include a disk drive 112, a network interface 114, and a serial/parallel interface 116. Disk drive 112 provides additional storage for data being printed or other information maintained by the printer 100. Although printer 100 is illustrated having both RAM 108 and a disk drive 112, a particular printer may include either RAM 108 or disk drive 112, depending on the storage needs of the printer. For example, an inexpensive printer may include a small amount of RAM 108 and no disk drive 112, thereby reducing the manufacturing cost of the printer.

Network interface 114 provides a connection between printer 100 and a data communication network. The network interface 114 allows devices coupled to a common data communication network to send print jobs, menu data, and other information to printer 100 via the network. Similarly, serial/parallel interface 116 provides a data communication path directly between printer 100 and another electronic or computing device. Although printer 100 is illustrated having a network interface 114 and serial/parallel interface 116, a particular printer may only include one interface component.

Printer 100 can also include a user interface and menu browser 118, and a display panel 120. The user interface and menu browser 118 allows a user of the printer 100 to navigate the printer's menu structure. User interface 118 can be indicators or a series of buttons, switches, or other selectable controls that are manipulated by a user of the printer. Display panel 120 is a graphical display that provides information regarding the status of the printer 100 and the current options available to a user through the menu structure.

Printer 100 also includes a print unit 124 that includes mechanisms arranged to selectively apply ink (e.g., liquid ink) to a print media such as paper, plastic, fabric, and the like in accordance with print data corresponding to a print job.

Print unit 124 can comprises a print carriage 140, one or more print heads 142, and one or more print nozzles 144. The print unit can be operably coupled with an ink droplet trajectory detector or sensor structure 150. For example, one configuration allows a sensor structure-print head assembly to travel together on the printer carriage during printing so that ink droplet trajectories can be monitored during printing. Alternatively, a print unit can access the sensor structure when the print unit accesses a service station 152.

The service station 152 can include a spittoon 154 for allowing ink to be cleared from the ink nozzles to prevent clogging. In one embodiment, sensor structure 150 can be positioned in the service station 152 so that it can be accessed by multiple print heads. This can allow the sensor structure to monitor ink droplet trajectories when a print head fires into the spittoon to minimize clogging of the nozzles 144.

The print head 142 usually has multiple nozzles 144 that are fired individually to deposit drops of ink onto the print media according to data that is received from the processor 102. As an example, the print head might have nozzles that number into the hundreds. A "firing" is the action of applying a firing pulse or driving voltage to an individual nozzle to cause that nozzle to eject an ink drop or droplet. The firing can be controlled by the processor 102.

Exemplary First Embodiment

Figure 3:
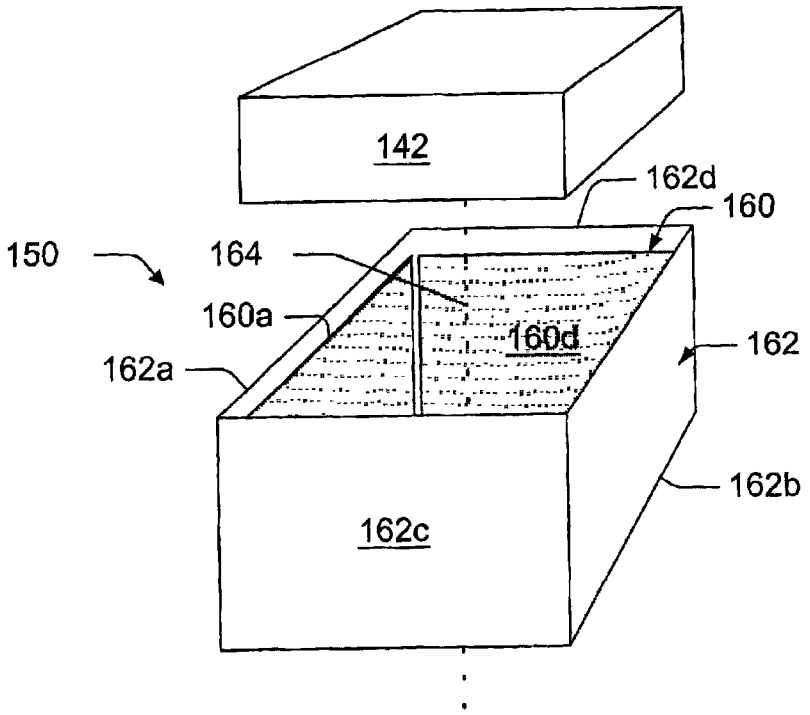
FIG. 3 is a perspective view of an exemplary sensor structure in accordance with one embodiment.

FIG. 3 shows one exemplary embodiment of a sensor structure or ink droplet trajectory detector 150 configured to sense the trajectories of ink droplets. The various components described below may not be illustrated accurately as far as their size is concerned, rather FIGS. 3–7 are intended as diagrammatic representations to illustrate to the reader various inventive principles that are described herein.

Figure 6:
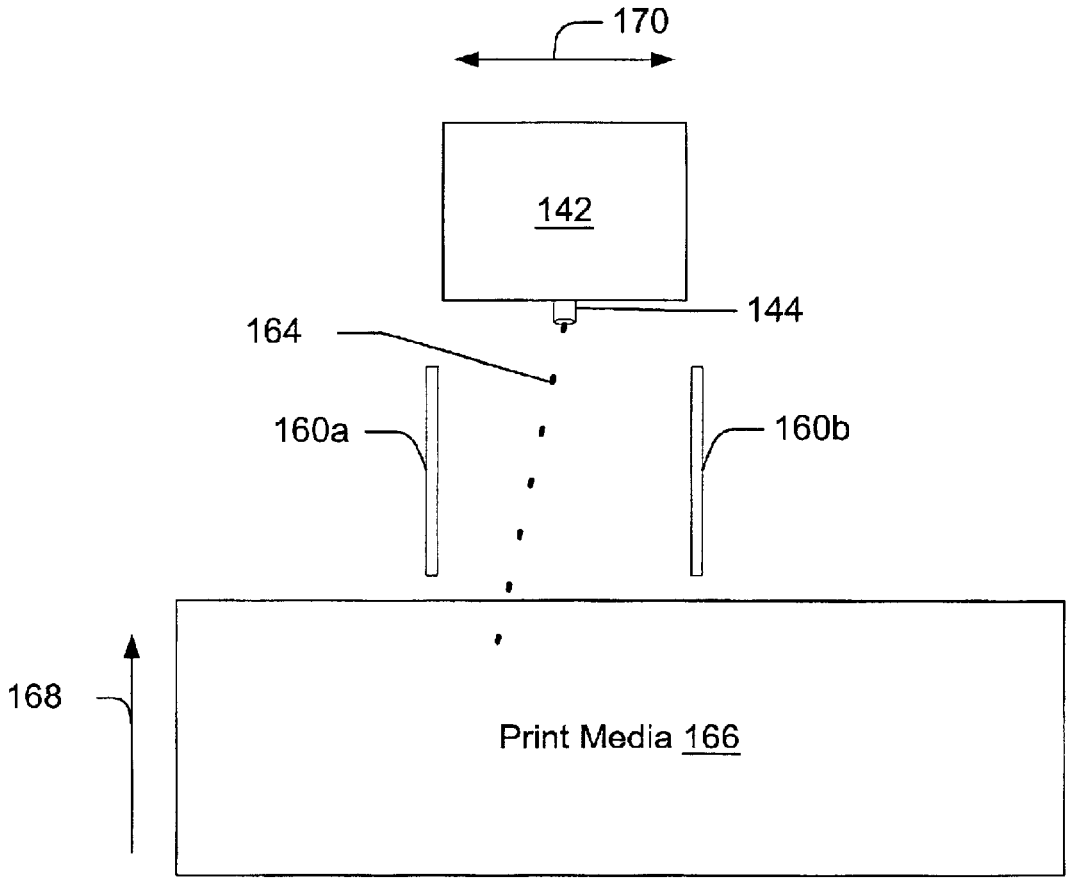
FIG. 6 is a front elevational view of an exemplary sensor structure depicted in use.

FIG. 3 shows a print head 142 that contains print nozzle(s) 144 (shown in FIG. 6). The print head 142 is positioned above sensor structure 150. The sensor structure can comprise sensors 160 oriented or supported by a structure 162. In this example, structure 162 comprises a housing that is shaped to allow ink droplets 164 to pass therethrough and to contact a print media (not shown). The housing is open ended and comprised of four joined sides 162*a*–162*d*. In this particular embodiment, the housing defines a passageway in the form of a rectangular box shape with open ends and solid sides 162*a*–162*d*. Further, as shown in this embodiment, the sides 162*a*–162*d* can be about 0.33 inches high. Sides 162*c* and 162*d* can be about 0.25 inches wide, and sides 162*a* and 162*b* can be about 0.5 inches wide. As can be seen in FIG. 3, the four sides are oriented as two pairs of opposing sides. In this example, sides 162*a* and 162*b* comprise one pair of sides, and side 162*c* and 162*d* comprise another pair of sides. The individual sides of the opposing pairs of sides face one another and respectively support the four sensors 160*a*–160*d*. Each side has a single sensor mounted on it. For purposes of clarity, sensor 160*a* is mounted on side 162*a* and so on. Although all four sides 162*a*–162*d* are visible in FIG.

3 only two of the sensors-160*a* and 160*d* are visible. The sensors are described in more detail below.

Figure 4:
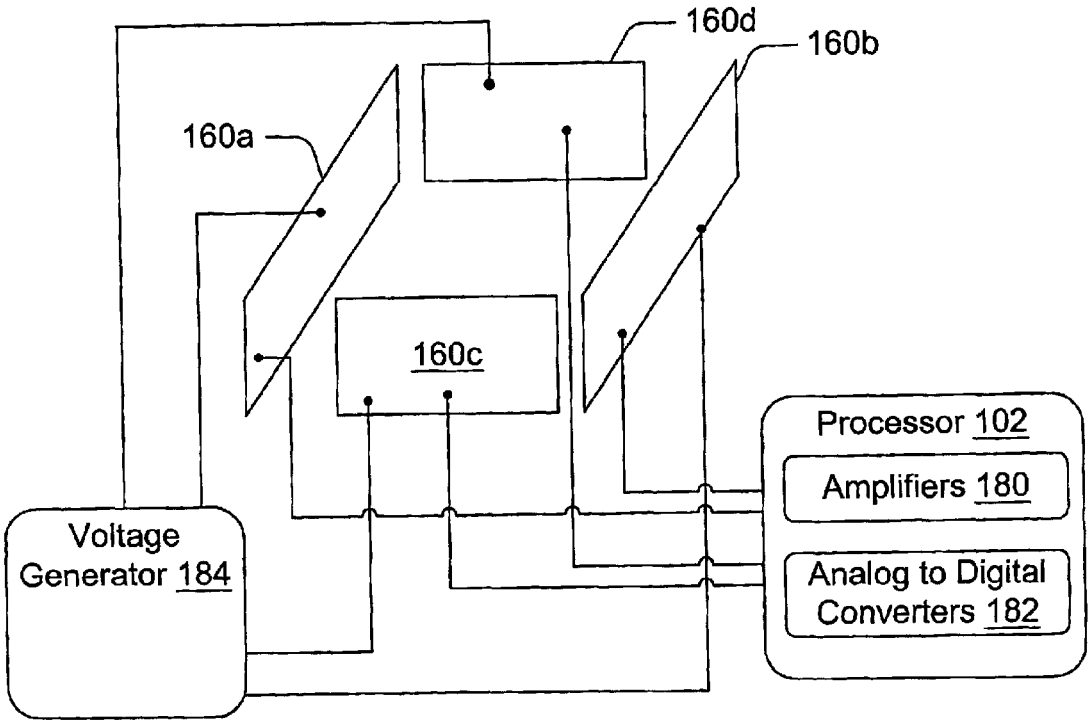
FIG. 4 is an exploded perspective view of an exemplary sensor structure in accordance with one embodiment.
Figure 5:
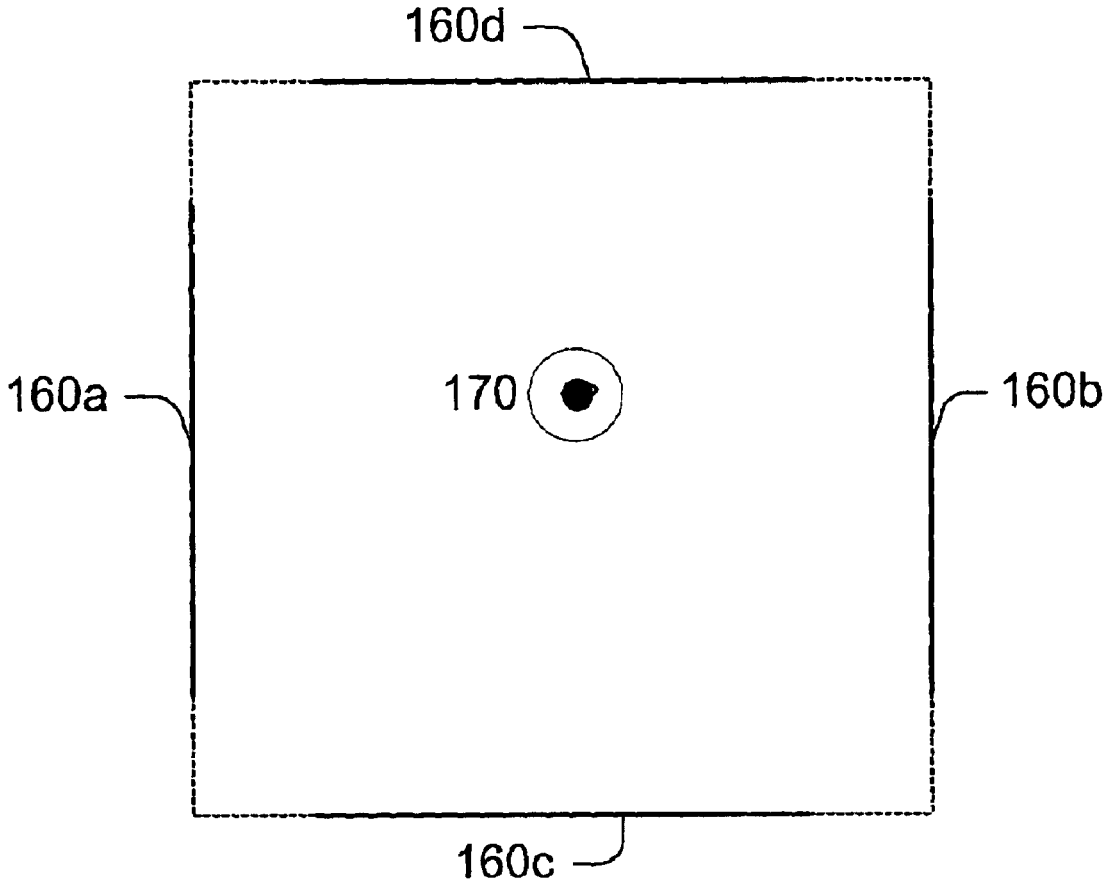
FIG. 5 is a transverse cross-sectional view of an exemplary sensor structure in accordance with one embodiment and depicts a droplet trajectory.

FIG. 4 shows the four sensors of FIG. 3 (160*a*–160*d*) apart from the housing. In this embodiment, the four sensors are also arranged as two sets of opposing pairs of sensors. In this example, 160*a* and 160*b* constitute a pair, and 160*c* and 160*d* constitute a pair. In this embodiment the sensors approximate a generally rectangular shape when viewed along an axis of desired ink drop travel. For example, FIG. 5 shows sensors 160*a*–160*d* as they appear when viewed along axis 170. Axis 170 constitutes an axis of desired ink drop travel.

In the present embodiment, as is evident from FIGS. 3 and 4, the four sensors are generally planar in construction and are positioned relative to one another to approximate a 4-sided polyhedron. Further, each side of the 4-sided polyhedron is a parallelogram (in this case, a right parallelogram whose sides are oriented to define right angles relative to one another), and opposing sides of the 4-sided polyhedron lie in generally parallel planes.

Each of the sensors 160*a–d* is configured to generate an electrical signal when an ink droplet passes through the housing, without requiring the ink droplet to physically engage any portion of the sensors. The sensors can be constructed from sheets of metal foil or other conductive materials. In this embodiment, the housing provides the structural integrity to support the sensors and can be formed from an electrically insulative material such as plastic. The sensors can be fastened to, or otherwise attached to the housing in any suitable way. For example, the metal foil can be molded into the housing or bonded to the housing with adhesive. In the embodiment shown in FIG. 3, the sensors can be pliant and can assume the shape of the housing upon which each is attached. Alternatively, the sensors can be constructed from more rigid materials and thus minimize the need for the housing or structure 162. For example, the sensors of FIG. 4 can be constructed from stamped sheets of metal and the structure can comprise plastic clips, inserted at the vertical ends of the sensors, that hold the sensors in the proper orientation and keep the sensors electrically isolated from one another.

FIG. 4 shows the sensors operably coupled with the processor 102. In this example, the processor can include amplifiers 180 and analog-to-digital converters 182. The processor is configured to process signals from the sensors to determine a sensed trajectory of the ink droplet through the housing relative to a desired trajectory. The sensors can generate analog signals and the processor can convert the analog signals to digital signals for processing. Alternatively, the signals from the sensors can be amplified by the amplifiers 180 and converted to digital signals by the Analog-to-digital converters 182 before being received by the processor. The processor can then calculate a difference parameter associated with the signals generated by each of the opposing pairs of sensors. The processor can be configured to quantify an amount of deviation of the sensed ink droplet trajectory from the desired trajectory using an amplitude associated with the difference parameter. A specific example of how this can be done is described below.

FIG. 4 further shows a voltage generator 184. In this non-limiting embodiment, the voltage generator is electrically connected to the sensors 160*a–d*. The voltage generator can impart a charge on the sensors 160. The charged sensors can cause inductive charging of the ink droplet 164. This is discussed in more detail below.

FIG. 6 shows one pair of sensors, 160*a* and 160*b*. For the sake of explanation sensors 160*c* and 160*d* are not shown, but a similar procedure to that which is described below can be applied to that pair of sensors as well. FIG. 6 also generally indicates print media 166. FIG. 6 does not represent the print media orientationally correct in that from this cross sectional angle the print media would actually lie on an orthogonal plane into and out of the page, and therefore, only the thickness of the print media would be visible. The print media can travel into the printer along the axis indicated by indicator 168, which again is actually into and out of the page. The direction of print media travel is often referred to as "Paper-Axis Directionality" (or "PAD"). This configuration can allow a pair of sensors to be oriented in parallel to selected edges of print media for which the printer is designed. For example, here 160*a* and 160*b* are oriented generally parallel to the side edges of a typical sheet of paper as it travels through the printer. Though not shown, it should be understood that sensors 160*c* and 160*d* can be parallel to the top and bottom edges of the paper.

The print head 142 can travel on the print carriage (not shown). The print head generally travels in a plane perpendicular to the direction of print media travel. This is commonly referred to as "Scan-Axis Directionality" (or "SAD").

FIG. 6 shows one example of how the sensors can be arranged to sense for ink droplet errors in the SAD axis. Similarly, 160*c* and 160*d* can sense for PAD trajectory errors. In this non-limiting example, at least one charged ink droplet is ejected from print nozzle 144. At least one charged ink droplet can comprise a charged single ink droplet, a series of ink droplets, bursts of ink droplets, or series of bursts of ink droplets.

In the embodiment illustrated in FIG. 6, the sensors 160*a* and 160*b* can be positioned approximately two millimeters in the vertical direction below a print nozzle contained in print head 142. The sensors 160*a* and 160*b* can further be electrically charged by voltage generator 184. The electrical charge of the sensors can inductively charge an ink droplet ejected from the print head. In this embodiment, the voltage generator 184 can be a DC voltage generator. The voltage generator can supply approximately 120 volts to the sensors. Many other satisfactory embodiments exist and will be recognized by those of skill in the art. For example, the sensors 160*a* and 160*b* can be approximately one vertical millimeter from the nozzle and be charged to 60 volts.

The passage of the charged ink droplet through the sensor structure can generate signals in sensors 160*a* and 160*b*. These signals can be received by processor 102. The processor computes a difference parameter of the signals. For example, the processor can subtract the right sensor signal (160*b*) from the left sensor signal (160*a*). If the difference parameter is zero, then the ink droplet traveled along the desired trajectory in the SAD axis. A positive output shows the trajectory is angled toward the left relative to the desired pathway, and if it is negative the trajectory is angled to the right. This computation can be accomplished with the equation:

$$\text{Output_Signal} = \text{Left Sensor_Signal} - \text{Right Sensor_Signal}$$

The output signal can represent the amplitude of the droplet's deviation from a desired pathway. The amplitude can be compared to a predetermined set of values to determine the angle of misdirection in degrees relative to this axis. Such set of values can be maintained in a look up table in the printer.

Figure 7:
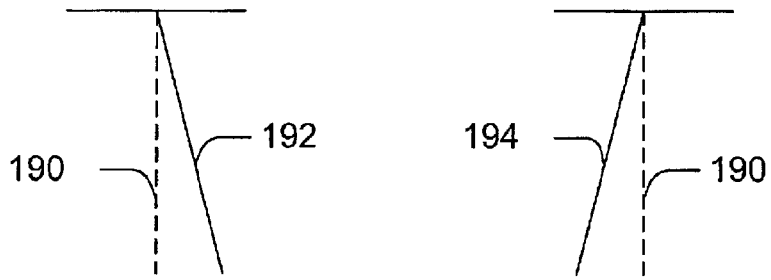
FIG. 7 shows an exemplary representation of sensor signals in accordance with one embodiment.

For example, FIG. 7 shows a graphical representation of a set of signals generated as a result of the ink droplet trajectory shown in FIG. 6. A signal representing a desired trajectory 190 is shown as a dotted line for the sake of comparison. In this embodiment, the desired trajectory 190 is a vertical line. Graphical signal 192 represents a signal generated by sensor 160*a*, and graphical signal 194 represents a signal generated by sensor 160*b*. Graphical signal 192 is stronger than it would be for a desired pathway, and graphical signal 194 is weaker than it would be for a desired pathway. When these signals are processed using the above-described formula, the results can show a positive difference parameter indicating that the sensed trajectory was to the left of the desired trajectory.

Also note that the sensor structure can perform a dual role. For example, if the processor signals the nozzle to eject an ink droplet and the sensors don't generate any signals, then some type of print nozzle malfunction may be occurring and an appropriate response can be generated.

First Exemplary Method for Determining an Ink Drop Trajectory

Figure 8:
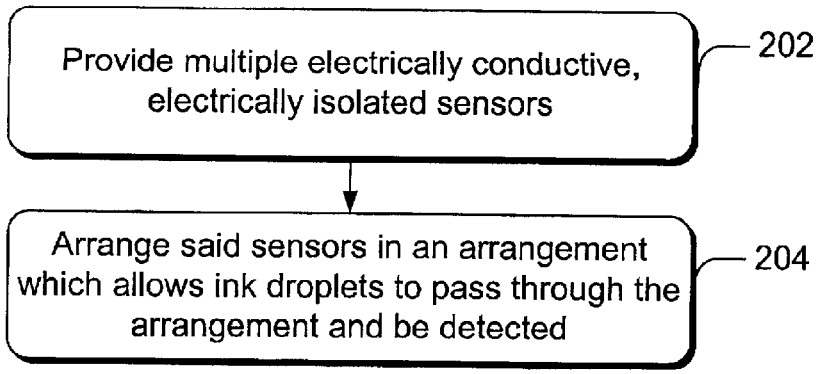
FIG. 8 is a flow diagram describing steps in a method in accordance with one embodiment.

FIG. 8 illustrates steps in a method for an ink droplet detection system, in accordance with one embodiment. The order in which the method is described is not intended to be construed as a limitation. Furthermore, the method can be implemented in any suitable hardware, software, firmware, or combination thereof.

Step 202 provides multiple electrically conductive, electrically isolated sensors. Each of the sensors can be configured to generate an electrical signal when an ink droplet passes in proximity to the sensor, without requiring the ink droplet to physically engage any portion of the sensors. Several embodiments have been described, but many possibilities exist. Any type of sensor which results in a signal which can be useful in determining the trajectory of ink droplets without having to physically touch the ink droplets can be provided.

The sensors can be constructed in many ways. For example, in one nonlimiting embodiment the sensors can be constructed from strips of metal foil or other electrically conductive solids which can comprise a suitable shape. The sensors can also be constructed from a composite material such as doped silicon. Alternatively, the sensors can be constructed from conductive liquids. For example, the sensor could be a salt dissolved in water interspersed in a foam or other porous material. The sensors can be very malleable and can be formed to the shape of the structure 162. Such an example is shown in FIG. 3 where the sensors 160 comprise foil strips and the structure can provide shape and orientation to the sensors. Alternatively, the sensors can be rather rigid with only portions of the sensor contacting the structure 162. For example the structure can comprise a cylindrical passageway with four rigid sensors positioned in the structure so that when viewed along an axis of desired ink droplet travel, the four sensors approximated a square or rectangular configuration.

Step 204 arranges the sensors in an arrangement which allows ink droplets to pass through the arrangement of sensors and be detected without requiring the droplets to physically engage the sensors. Arranging the sensors can be accomplished in various ways. FIG. 3 describes one embodiment where the arrangement is accomplished using a four-sided housing or structure 162. This arrangement orients two opposing pairs of sensors, one pair oriented in the PAD axis and one pair in the SAD axis. This configuration can minimize computational requirements. Many other configurations are possible. For example, three sensors can be arranged in a polyhedron which has a triangular configuration when viewed along an axis of desired ink droplet travel.

The construction of the structure 162 can be of any suitable type that can suitably arrange the sensors 160. For example, a simple frame construction can hold the sensors. The structure can be constructed from any suitable material. For example, the structure can be constructed from a non-electrically conductive material with each of the sensors positioned on the structure so that they are electrically isolated from one another. Many types of plastics are inexpensive and easily shaped and can provide satisfactory embodiments. Alternatively, the sensors can be arranged without supplying a dedicated housing or structure by instead positioning the sensors in an existing structure. For example, the sensors can be arranged by utilizing the existing components of the service station or mounting the sensors directly to the printhead.

Second Exemplary Method for Determining an Ink Drop Trajectory

Figure 9:
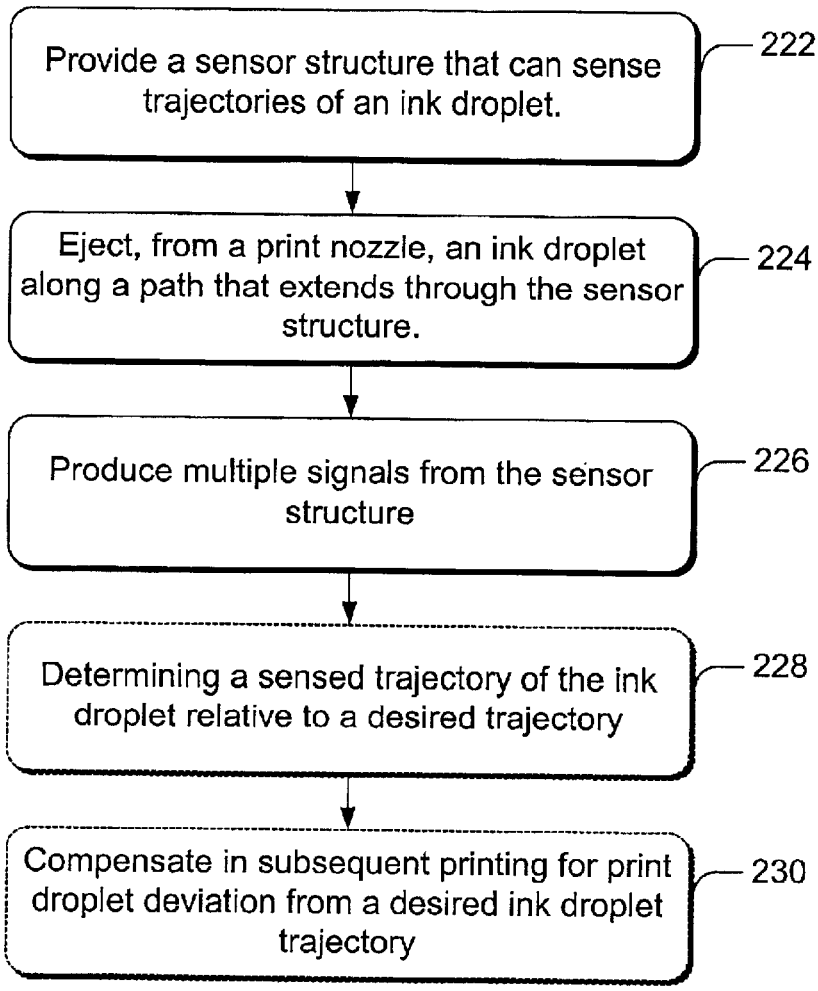
FIG. 9 is a flow diagram describing steps in a method in accordance with one embodiment.

FIG. 9 is a flow diagram that describes steps in a method in accordance with one embodiment.

Step 222 provides a sensor structure that can sense trajectories of ink droplets without physically contacting the ink droplets. A satisfactory non-limiting embodiment is described above in relation to FIGS. 3–7. Any sensor structure that can be configured to generate multiple signals upon the passage of an ink droplet in proximity to the structure can be satisfactory.

Step 224 ejects from a print nozzle, an ink droplet along a path that extends through the sensor structure. Any print nozzle or analogous device that can be configured for printing can satisfactorily eject the ink droplet.

Step 226 produces multiple signals from the sensor structure. Suitable sensor structures are described above. Step 228 processes the signals to determine a sensed trajectory of the ink droplet relative to a desired trajectory. Any type of processing that generates data that can be used to determine the sensed trajectory can be satisfactory. Examples of this are given above.

Step 230 compensates in subsequent printing for print droplet deviation from the desired trajectory. This can be accomplished by adjusting the position of the print head when a nozzle contained on the print head is found to provide an ink droplet that deviates from the desired trajectory. When the nozzle is fired the position of the print head can be adjusted to compensate for the deviation. Thereby resulting in increased print quality.

CONCLUSION

By sensing ink droplets without requiring physical contact with the ink droplets, the systems and methods described provide useful information that can be used to lead to better print quality from the printer.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. An ink droplet trajectory detector comprising:

at least two sensors including a pair of opposing sensors;

a structure orienting the at least two sensors relative to one another; and, wherein each of the at least two sensors is configured to generate an electrical signal when an ink droplet passes the at least two sensors, and wherein electrical signals represent relative distances between the ink droplet and the pair of opposing sensors and wherein the electrical signals are in response to a charge on the ink droplet.

2. The ink droplet trajectory detector of claim 1, wherein each of the at least two sensors is configured to charge the ink droplet prior to release of the ink droplet by the print nozzle.

3. The ink droplet trajectory detector of claim 1, wherein the at least two sensors are configured to charge the ink droplet prior to passage by the ink droplet by the at least two sensors.

4. The ink droplet trajectory detector of claim 1, wherein the structure comprises a housing inside of which the at least two sensors are mounted.

5. The ink droplet trajectory detector of claim 1, wherein the structure has a generally rectangular shape when viewed along an axis of desired ink droplet travel.

6. The ink droplet trajectory detector of claim 1, wherein said detector is configured to be positioned in a printer service station.

7. The ink droplet trajectory detector of claim 6, wherein said detector is configured to be used with multiple print heads of a printer.

8. An ink droplet trajectory detector comprising:

multiple electrically conductive, electrically isolated sensors;

at least one structure orienting said sensors relative to one another, wherein said structure comprises a housing inside of which the sensors are mounted;

each of said sensors being configured to generate an electrical signal when at least one ink droplet passes in proximity thereof, without requiring said ink droplet to physically engage any portion of said sensors;

wherein said sensors are oriented by said structure to approximate a generally rectangular shape when viewed along an axis of desired ink droplet travel; and wherein said sensors comprise two sets of opposing pairs of sensors.

9. The ink droplet trajectory detector of claim 8 further comprising a processor configured to process the electrical signals from the at least two sensors to determine a trajectory of the ink droplet.

10. The ink droplet trajectory detector of claim 5, wherein the electrical signals from the at least two sensors are processed by the processor to derive an output by subtracting one signal from another signal.

11. The ink droplet trajectory detector of claim 5, wherein amplitudes of the electrical signals from the at least two sensors are compared by the processor to result in information about a degree by which the ink droplet is deflected from a desired trajectory.

12. The ink droplet trajectory detector of claim 5, additionally comprising a look-up table containing values of the electrical signals and their associated angles at which the ink droplet moves.

13. The ink droplet trajectory detector of claim 5, wherein the processor is configured to calculate a difference parameter associated with the electrical signals generated by each pair of opposed sensors.

14. The ink droplet trajectory detector of claim 13, wherein the processor is configured to ascertain, from a sign of each difference parameter, whether the trajectory of the at least one ink droplet is oriented more towards one sensor or the other of each pair of opposed sensors.

15. The ink droplet trajectory detector of claim 14, wherein the processor is configured to quantify an amount of deviation of the trajectory from the desired trajectory using an amplitude associated with the difference parameters.

16. The ink droplet trajectory detector of claim 15, wherein the processor is configured to quantify the amount of deviation from a desired trajectory in terms of degrees.

17. An ink droplet trajectory detector comprising:

an open-ended structure defining a passageway through which an ink droplet can pass;

at least two sensors supported by the open-ended structure; and, wherein each of said sensors is configured to apply an electrical charge to the ink droplet prior to passage by the ink droplet through the open-ended structure.

18. The ink droplet trajectory detector of claim 17, wherein each of the sensors is configured to detect the passage of the ink droplet by sensing its charge.

19. The ink droplet trajectory detector of claim 17, electrical signals from the at least two sensors are processed by subtracting one signal from another signal to determine a trajectory of the ink droplet between two sensors.

20. The ink droplet trajectory detector of claim 17, wherein the structure comprises two pairs of opposing sides, and wherein individual sides of each pair of opposing sides face one another.

21. The ink droplet trajectory detector of claim 17, wherein the at least two sensors are generally planar and are positioned relative to one another to approximate a 4-sided polyhedron through which ink droplets can pass.

22. The ink droplet trajectory detector of claim 21, wherein amplitudes of the signals from the at least two sensors are compared to result in information about a degree to which the ink droplet is deflected from a desired trajectory.

23. The ink droplet trajectory detector of claim 22, additionally comprising a look-up table wherein values of the signals are associated with angles at which the ink droplet moves.

24. The ink droplet trajectory detector of claim 17 further comprising a processor configured to process signals from the at least two sensors to determine a trajectory of the ink droplet.

25. The ink droplet trajectory detector of claim 24, wherein the processor is configured to process signals by calculating a difference parameter associated with the electrical signals generated by opposed pairs of sensors.

26. The ink droplet trajectory detector of claim 24, wherein the processor is configured to quantify an amount of deviation of the trajectory from a desired trajectory using an amplitude associated with the difference parameters.

27. The ink droplet trajectory detector of claim 24, wherein the processor is configured to quantify the amount of deviation from the trajectory of a desired trajectory in degrees.

28. An inkjet printer comprising:

a print head for ejecting ink droplets onto a print media; and an ink droplet sensor assembly operably associated with the print head, the ink droplet sensor assembly comprising:

at least two sensors;

a structure orienting the at least two sensors relative to one another; and, wherein each of the at least two sensors are configured to generate an electrical signal in response to charge on the ink droplets, expressing relative distances between the ink droplets and pairs of sensors among the at least two sensors when the ink droplets pass in proximity to the at least two sensors.

29. The printer of claim 28, wherein the sensors are configured in at least one pair to generate electrical signals from which it may be determined by which sensor the ink droplet passed nearer.

30. The printer of claim 28 further comprising a voltage generator electrically connected to the sensors.

31. The printer of claim 28 further comprising a processor to compare amplitudes of the electrical signals from the at least two sensors to obtain information about a degree by which the ink droplet is deflected from a desired trajectory.

32. The printer of claim 28, wherein the print head and the ink droplet sensor assembly are configured to move together during printing.

33. The printer of claim 28, wherein said sensors are oriented to approximate a rectangle when viewed along an axis of desired ink droplet travel.

34. A method of detecting a trajectory of an ink droplet, comprising:

charging an ink droplet prior to firing from a printhead by applying a charge to at least two sensors; and passing the ink droplet by the at least two sensors, wherein the at least two sensors are configured to generate signals in response to the charge on the ink droplet indicating to which sensor the ink droplet is closer.

35. The method of claim 34, additionally comprising comparing the generated signals to obtain information about a degree bywhich the ink droplet deviates from a desired trajectory.

36. The method of claim 34, wherein charging the ink droplet comprises applying a positive charge to the at least two sensors to result in a negative charge on the ink droplet.

37. The method of claim 34, additionally comprising consulting a look-up table to find values associating the generated signals with angles at which the ink droplet moves.

38. The method of claim 34, additionally comprising quantifying an amount of deviation between a trajectory of the ink droplet and a desired trajectory of the ink droplet using the generated signals.

39. A method for determining a trajectory of an ink droplet comprising:

charging a sensor structure with a first electrical charge sufficient to result in a second electrical charge, opposite to the first electrical charge, on at least one ink droplet prior to release by a print nozzle;

ejecting, from the print nozzle, the at least one ink droplet along a path that extends through the sensor structure; and, processing signals from the sensor structure, wherein the signals are responsive to said at least one ink droplet passing in proximity to the sensor structure, and wherein the signals express relative distances between sensors within the sensor structure.

40. The method of claim 39 further comprising determining a sensed, trajectory of the at least one ink droplet relative to a desired trajectory.

41. The method of claim 40, further comprising compensating in subsequent printing for ink droplet deviation from the desired trajectory.

42. One or more computer-readable media comprising computer-readable instructions thereon which, when executed by a printing device, cause the printing device to:

eject at least one ink droplet from a print nozzle through a sensor structure that supports multiple electrically isolated sensors;

receive from said multiple electrically isolated sensors multiple electrical signals responsive to said at least one ink droplet passing in proximity to said sensors; and, process the multiple signals to determine a path of said at least one ink droplet.

43. The computer readable media of claim 42, additionally comprising instructions which cause the printing device to compensate for a determined ink droplet path that deviates from a desired ink droplet path.

44. A printing device comprising:

a print head configured to eject an ink droplet;

at least two sensors configured to charge the ink droplet;

at least one open ended structure orienting the at least two sensors so that the ink droplets ejected from the print head can pass between the at least two sensors without the ink droplets physically engaging any portion of the at least two sensors; and, wherein the at least two sensors are configured to generate electrical signals in response to the ink droplets passing in proximity of the at least two sensors.

45. The printing device of claim 44, wherein the at least two sensors comprise a conductive solid material.

46. The printing device of claim 44, wherein the at least two sensors comprise metal foil.

47. The printing device of claim 44, wherein the at least two sensors comprise stamped metal sheets.

48. The printing device of claim 44, wherein the at least two sensors comprise a conductive liquid.

49. The printing device of claim 44 further comprising a voltage generator electrically coupled to the at least two sensors and configured to electrically charge the at least two sensors to charge ink droplets ejected from the print head.

50. A printing device comprising:

a print head configured to eject an ink droplet;

a structure having a passageway through which the ink droplet can pass;

at least two sensors oriented relative to one another by the structure so that the ink droplet can pass between the at least two sensors without the ink droplet physically engaging any portion of the at least two sensors; and, wherein the at least two sensors are further configured to generate electrical signals in response to a charge on the ink droplet when the ink droplet passes in proximity of the at least two sensors, wherein the electrical signals express a distance between each of the at least two sensors and the ink droplet.

51. The printing device of claim 50, wherein the structure comprises a plastic housing.

52. The printing device of claim 50, wherein the structure comprises an open-ended box.

* * * * *